United States Patent [19]

Fekete

[11] Patent Number: 4,708,597

[45] **Date of Patent: * Nov. 24, 1987**

[54] PLUNGER WITH SIMPLE RETENTION VALVE

[75] Inventor: Amnon V. Fekete, Calle Chineborazo, Venezuela

[73] Assignee: Intevep, S.A., Caracas, Venezuela

[ * ] Notice: The portion of the term of this patent subsequent to May 27, 2003 has been disclaimed.

[21] Appl. No.: 866,849

[22] Filed: May 23, 1986

Related U.S. Application Data

[63] Continuation-in-part of Ser. No. 427,158, Sep. 29, 1982, Pat. No. 4,591,316.

[51] Int. Cl.[4] ..... F04B 3/00; F04B 7/00

[52] U.S. Cl. ..... 417/259; 417/513; 417/514; 417/520; 92/168

[58] Field of Search ..... 92/168; 417/510–514, 417/520, 259

[56] References Cited

U.S. PATENT DOCUMENTS 2,326,378 8/1943 McConnohie ..... 417/512
3,186,354 6/1965 Mahoney ..... 417/513 X
4,012,173 3/1977 Everson ..... 417/259
4,591,316 5/1986 Fekete ..... 417/259

*Primary Examiner*—Carlton R. Croyle
*Assistant Examiner*—T. Olds
*Attorney, Agent, or Firm*—James G. Staples

[57] ABSTRACT

A fluid pump is disclosed having a plunger reciprocating within a working cylinder and a standing intake retention valve. The plunger comprises a stem having affixed to it a plug and a stop, a body being slidably engaged to the cylinder an located on the discharge side of the plug and on the intake side of the stop. Upon the upstroke of the plunger, a plug surface engages with a body seal and therefore pumps the fluid before it. Meanwhile, fluid flows in behind the plunger through the standing intake retention valve. Optionally, a standing discharge retention valve is employed to alleviate the vapor lock condition caused by the combination of counterpressure effect and gases in the fluid. On the downstroke, the plug disengages from the body, allowing fluid to flow noncompressibly past the plunger. Wiper means keep the cylinder surface clean of precipitated solids, so as to prevent abrasion to the sliding exterior surface of the body.

4 Claims, 1 Drawing Figure

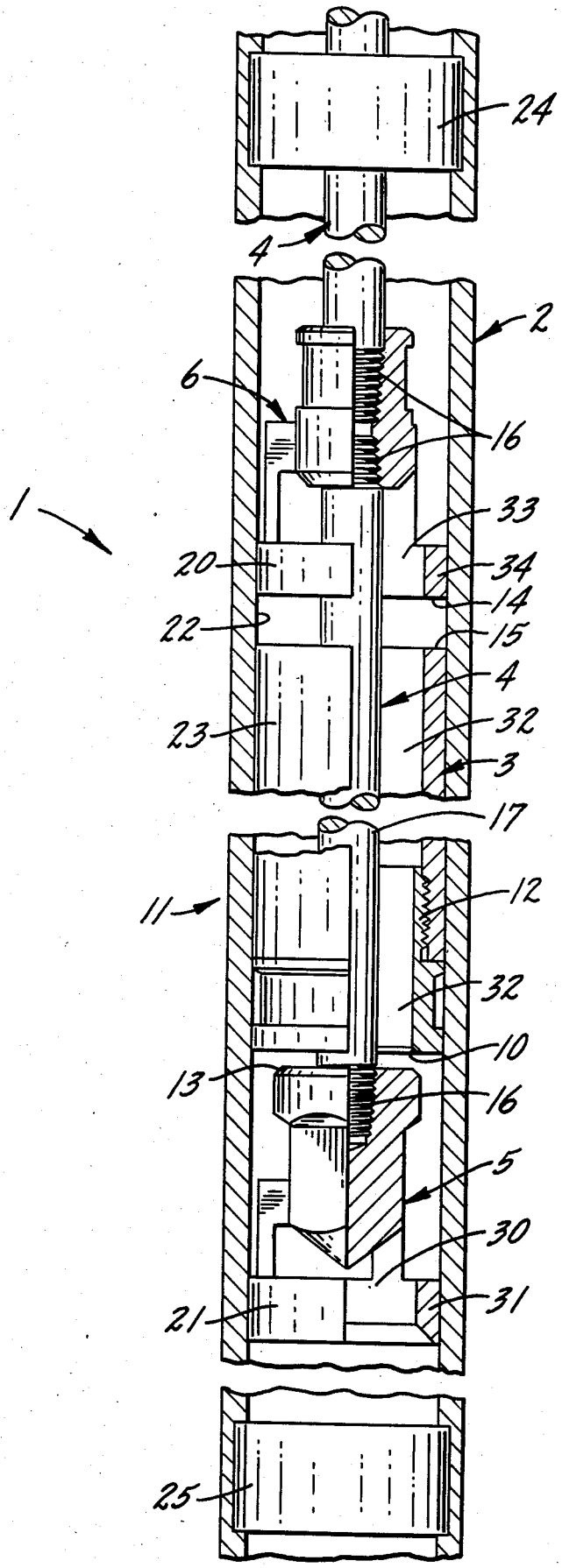
24
4
2
6
16
1
33
20
34
14
22
15
4
23
32
3
17
11
12
32
10
13
16
5
30
21
31
25

PLUNGER WITH SIMPLE RETENTION VALVE

This application is a continuation-in-part of pending application Ser. No. 427,158, filed Sept. 29, 1982, now U.S. Pat. No. 4,591,316, issued May 27, 1986.

SUMMARY OF THE INVENTION

The present invention relates generally to the positive displacement pumping of fluids, and more specifically to the pumping or compression of viscous fluids which may contain gases and suspended solids.

A principal object of the present invention is to overcome the limitations of the plungers present in positive-displacement pumps (or compressors) found in the prior art by providing a pump (or compressor) with an optimal pressure ratio and a maximum area of possible flow through a simple retention valve secured to the plunger.

A plunger meeting this object comprises a cylindrical body which slides within a working cylinder, a stem which transmits a periodic movement to a plug which can seal with a seat on the body as the plunger moves in one direction, and which can transmit through any other means the movement of the stem to the body in the other direction.

This plunger, together with a standing retention valve secured to the working cylinder at a point in the intake direction from the plunger, constitutes a pump which may be used for pumping viscous fluids with or without significant concentrations of suspended solids.

In the event that pumping or compression conditions are such that there is a high counterpressure and a large amount of steam and/or other gases in the pumped fluid, then a second standing retention valve may be secured to the working cylinder at a point in the discharge direction from the plunger. The plunger would then reciprocate between the two standing valves.

For a better understanding of the present invention, a possible embodiment of it and its operation will be described as they form part of a pump or compressor. The description of a possible embodiment set out below is merely for explanatory purposes and is in no way limitative of the present invention.

BRIEF DESCRIPTION OF THE DRAWING

FIG. 1 is an elevation of the invention as used in a vertical working cylinder, shown in half section.

DETAILED DESCRIPTION OF A POSSIBLE EMBODIMENT

FIG. 1 shows a possible design of the plunger of the present invention. The plunger 1 slidably reciprocates within a working cylinder 2 and comprises a cylindrical body 3, a stem 4, a simple retention plug 5, and a shoulder element 6. A sealing surface or seal 10 on lower portion 12 of body 3, together with plug 5, constitute a traveling retention valve 11 when seal 10 and plug 5 are engaged to each other.

Since traveling valve 11 is located in the suction end of the plunger, the pressure ratio in the pump is optimal.

The free space between stem 4 and seal 10 of cylindrical body 3 is the only factor which limits the flow area through the plunger. Thus, it is possible to optimize the flow area through traveling valve 11, taking as a limiting factor the space which exists between plug 5 and working cylinder 2. Simply, ease of flow is maximized where the flow area between plug 5 and working cylinder 2 is equal to the flow area between stem 4 and seal 10 of body 3.

Seal 10 takes the form of an annular bevel, and is mated to bevelled face 13 of plug 5. Shoulder element 6 has a shoulder face 14 which is designed to meet face 15 at the discharge end of body 3. Plug 5 and shoulder element 6 may be affixed to stem 4 in any conventional manner, as per screw means 16. In this embodiment, lower section 17 of stem 4 is screwed into shoulder element 6 (which also serves as a connector), and plug 5 is screwed onto the end of section 17.

Shoulder element 6 and plug 5 each have annular wiper faces 20, 21, which are slidably engaged with interior surface 22 of working cylinder 2. Exterior surface 23 of body 3 likewise slidably engages surface 22.

In the intake direction from plunger 1 is a standing retention valve 24 affixed to working cylinder 2, which permits fluid to flow through it in a discharge direction only. In certain circumstances set out below, a second standing retention valve 25 is affixed to working cylinder 2 at a point in a discharge direction from plunger 1. It also permits fluid flow in the discharge direction only.

An operation of the plunger is presented as it is applied to pumps in which the stem is moved in a vertical direction, like in the underground pumps used in the petroleum industry. The operation is however valid for all pumps (or compressors) using the principle of positive displacement. If the stem is moved in a direction other than vertical, then only the component of the gravitational force which is normal to the direction of movement need be specially considered.

During the operation of the pump, when the stem 4 commences to descend from the extreme upper position, the annular discharge retention valve 25, used optionally when there is a large counter-pressure and high concentrations of steam and/or gases dissolved in the fluid, is closed, thereby supporting the effects of the counterpressure and the weight of the fluid column located above the valve.

Meanwhile, shoulder element 6 is propelled downward by stem 4 until its shoulder face 14 abuts upper face 15 of body 2. The downward movement of shoulder element 6 is aided by either the entire weight of the fluid column above it or, where discharge valve 24 is employed, by the weight of the reduced fluid column between discharge retention valve 24 and shoulder element 6. Body 3 at this point has ceased motion, principally because of frictional forces between sliding body surface 23 and working cylinder surface 22, but also because pressure has increased between intake standing retention valve 25 and traveling retention valve 11. The relative movement of stem 4 with respect to body 3, and therefore the relative movement of segment 17 and plug 5 with respect to body 3, causes bevelled face 13 of plug 5 to disengage from the annular bevelled seal 10 of the body. The opening of traveling retention valve 11 is therefore caused by mechanical, rather than by pressure, means, and the compression of the fluid located between traveling valve 11 and standing intake valve 25 is not necessary.

When shoulder face 14 comes into contact with upper face 15 of body 2, the downward motion is transmitted to the body. As plunger 1 thereafter descends as a unit, fluid flows through the interior space 30 of plug annulus 31, past plug 5, through the flow area between plug face 13 and annular seal 10, through body interior 32, through the interior space 33 of shoulder annulus 34 and up past shoulder element 6. The fluid previously below plunger 1 is thus substantially noncompressibly displaced to a volume above the plunger.

Once plunger 1 reaches its extreme lower position and stem 4 starts to rise, bevelled face 13 of plug 5 closes the traveling valve 11 as soon as it makes contact with annular seal 10 of body 2 and imparts the ascending movement to the body. As this occurs, the relative speed of the fluid on either side of traveling valve 11 with respect to the valve is zero. As plunger 1 rises, a pressure drop is created inside working cylinder 2 between the traveling valve 11 and standing intake valve 25, until this pressure is less than that of the fluid below standing valve 25. At this point, fluid will flow through standing intake valve 25 to occupy the space behind traveling valve 11.

If the counterpressure and the steam and/or other gas concentrations so merit it, discharge standing retention valve 24 may also be employed. In that case, the fluid present inside working cylinder 2 between traveling valve 11 and standing discharge valve 24 will be compressed upon the upward movement of traveling valve 11 until the pressure in that volume is higher than the sum of the counterpressure effects and the weight of the fluid column above standing discharge valve 24. Standing discharge valve 24 then opens and allows for the outflow of the fluid.

Finally, when plunger 1 reaches its extreme upper position and commences to descend, standing intake retention valve 25 closes and the pumping cycle is repeated.

During the reciprocating motion of plunger 1, the polished exterior surface 23 of body 3 is slidably engaged to surface 22 of working cylinder 2. Without protection, polished surface 23 is susceptible to abrasion caused by the presence of precipitated solid particles on surface 22, which particles formerly were suspended solids within the fluid. To prevent this abrasion, wiper face 20 of shoulder element 6 wipes the surface 22 above body 3 during the upstroke, and wiper face 21 of plug 5 wipes surfaces 22 below body 3 during the downstroke of plunger 1.

The advantages of the present invention are:

1. Prior to the start of the suction cycle of plunger 1, the stem 4 causes the displacement of plug 5 toward seal 10 of cylindrical body 3, and it starts to close the opening of traveling retention valve 11. This takes place when the relative velocity of the fluid, on either side of traveling retention valve 11, is zero. Therefore, the erosion effects of the fluid upon annular seal 10 and bevelled plug face 13 are practically eliminated.

2. Since traveling retention valve 11 closes prior to the start of the suction of plunger 1, the pumped volume is practically the maximum volume.

3. If the pumped fluid contains a high concentration of steam and/or other gases, the fact that the traveling retention valve is forced open mechanically, and does not open by pressure differential, eliminates in only one plunger stroke the possible blocking of pumping action by steam and/or other gases.

4. If the pump is installed so that the stem 4 moves in a direction other than horizontal, the possibility exists that solids suspended in the fluid may be deposited on the traveling retention valve 11. The position of plug 5 in the plunger is such that the flow of fluid can relieve said valve.

5. The shape of plug 5 may be designed in such a manner that traveling valve 11 presents the maximum area of flow which is permitted with a simple retention plug, and such that it offers optimal fluid dynamic characteristics.

6. Shoulder wiper face 20 and plug wiper face 21 wipe working cylinder surface 22 clean of precipitated debris, thus protecting polished body surface 23 from abrasion.

7. Since plug 5 closes traveling valve 11 at the beginning of the upstroke of stem 4, the force of impact of bevelled face 13 onto annular seal 10 is practically nonexistent, thus preventing damage to traveling valve 11.

I claim:

1. A positive displacement retention valve apparatus in which the actual flow equals the theoretical maximum flow through the retention valve, said apparatus including, in combination, a confined fluid flow conduit, a piston adapted for reciprocal movement within the fluid flow conduit between upstream and downstream limit positions, piston reciprocating means, and pressure responsive check valve means located upstream with respect to the piston in the fluid flow conduit, said pressure responsive check valve means operable to permit fluid flow therethrough in a downstream direction toward the piston, and to preclude fluid flow therethrough in an opposite direction, said piston being composed of a plurality of parts which are relatively movable with respect to one another, said piston including a simple retention valve consisting of a plug means, a cylinder having a minimum and a maximum internal cross section flow area therein and being reciprocal within the confined fluid flow conduit, and a seat on the cylinder for the plug means, said piston reciprocating means having a wiper carried thereby located downstream from the cylinder which wipes the confined fluid flow conduit during compression movement of the piston reciprocating means, said piston reciprocating means being operatively connected to the plug means, said piston being arranged to close, and thereby block the fluid flow conduit, prior to the suction stroke of the piston, the flow area between the plug means and the fluid flow conduit being equal to the flow area between the plunger reciprocating means and the minimum internal cross sectional flow area of the cylinder downstream from the cylinder seat whereby the flow through the piston is optimized.

2. The positive displacement retention valve pump apparatus of claim 1 further characterized by and including:

a second pressure responsive check valve means located downstream with respect to the plunger in the fluid flow conduit, said second pressure responsive check valve means being operable to permit fluid flow therethrough in a downstream direction away from the plunger, and to preclude fluid flow therethrough in an opposite direction.

3. The positive displacement retention valve pump apparatus of claim 1 further characterized in that:

said piston reciprocating means has a second wiper carried thereby located upstream from the cylinder which wipes the confined fluid flow conduit during compression movement of the piston reciprocating means.

4. The positive displacement retention valve pump apparatus of claim 3 further characterizes by and including a second pressure responsive check valve means located downstream with respect to the plunger in the fluid flow conduit, said second pressure responsive check valve means being operable to permit fluid flow therethrough in a downstream direction away from the plunger, and to preclude fluid flow therethrough in an opposite direction.

* * * * *